US007740133B2

(12) United States Patent
Lamas

(10) Patent No.: US 7,740,133 B2
(45) Date of Patent: Jun. 22, 2010

(54) MARKER CADDY DEVICE INCLUDING A LASER POINTER DEVICE

(76) Inventor: Daniel Lamas, 8006 Allott Ave., Panorama City, CA (US) 91402

( * ) Notice: Subject to any disclaimer, the term of this patent is extended or adjusted under 35 U.S.C. 154(b) by 102 days.

(21) Appl. No.: 12/049,177

(22) Filed: Mar. 14, 2008

(65) Prior Publication Data

US 2008/0230407 A1 Sep. 25, 2008

Related U.S. Application Data

(60) Provisional application No. 60/918,569, filed on Mar. 19, 2007.

(51) Int. Cl.
*A45C 11/34* (2006.01)
*A47F 7/00* (2006.01)

(52) U.S. Cl. ..... 206/214; 206/224; 211/69.5

(58) Field of Classification Search ..... 206/214, 206/224, 371, 443, 38, 234; 211/69.1, 69.5; 248/314; 15/231; 7/118, 160
See application file for complete search history.

(56) References Cited

U.S. PATENT DOCUMENTS 4,815,622 A * 3/1989 Cramer ..... 206/214
4,875,591 A * 10/1989 Mikesell ..... 211/69.1
4,937,910 A * 7/1990 Frazier ..... 15/231
5,163,549 A * 11/1992 Hayduchok ..... 206/214
6,186,461 B1 * 2/2001 Pelaez ..... 206/214
6,202,862 B1 * 3/2001 Acquaviva et al. ..... 211/69.5
D443,645 S 6/2001 Booth
6,257,539 B1 7/2001 Pelaez
6,273,582 B1 * 8/2001 Taggart et al. ..... 7/118
6,367,115 B1 * 4/2002 Frazier ..... 15/231
6,663,305 B2 12/2003 Poulos
6,871,767 B2 * 3/2005 Perlman et al. ..... 206/214
7,314,142 B2 * 1/2008 Lyman, Jr. ..... 211/69.5
7,380,655 B1 * 6/2008 Thune et al. ..... 206/214
7,419,320 B2 * 9/2008 LaBrasca ..... 206/214
2003/0192786 A1 * 10/2003 Chao ..... 206/38
2009/0013566 A1 * 1/2009 Cetera ..... 206/214

* cited by examiner

*Primary Examiner*—Bryon P Gehman
(74) *Attorney, Agent, or Firm*—QuickPatents, Inc.; Kevin Prince

(57) ABSTRACT

A caddy is disclosed for holding at least one marker therein. The caddy comprises a body that has at least one elongated channel therein. Each channel is adapted to receive one of the markers slidably therein. Each channel terminates at a distal end in a fitted cap portion for hermetically receiving a marking end of one of the markers. Preferably the body is comprised of a plastic top shell and a plastic bottom shell each fixed together at a seam along peripheral edges thereof. The body further includes side edges having an ergonomic grip and a substantially flat bottom side for fixing thereto a removable eraser pad. A battery-operated laser pointer device may be further included within the body. An actuator activates the laser pointer device to produce a laser beam that projects through a laser beam aperture of the body.

5 Claims, 3 Drawing Sheets

MARKER CADDY DEVICE INCLUDING A LASER POINTER DEVICE

CROSS-REFERENCE TO RELATED APPLICATIONS

This application claims the benefit of U.S. Provisional Patent Application 60/918,569, filed on Mar. 19, 2007, and incorporated herein by reference.

STATEMENT REGARDING FEDERALLY SPONSORED RESEARCH AND DEVELOPMENT

Not Applicable.

FIELD OF THE INVENTION

This invention relates to marking devices, and more particularly to a novel marker caddy device.

DISCUSSION OF RELATED ART

The use of colored markers is extensive and well-known for various types of illustrative and other drawing purposes. The user of such markers typically requires several markers of different colors in order to create an effective and interesting presentation.

Conventional marker trays, made by the marker manufacturers for example, are designed to hold a plurality of markers, including the marker caps. In order to use any one particular marker that is held in such a conventional marker tray, the user must remove the marker from the tray, then remove the cap from the marker, and then use the marker. The process must be reversed to change colors, which is often overly time consuming and cumbersome, particularly when giving a presentation to or teaching a group of people.

U.S. Pat. No. 6,663,305 to Poulos on Dec. 16, 2003 teaches a marker holder for holding multiple marking implements, such as carpenter's pencils or lumber crayons. Such a device is not well-suited for use with whiteboard ink markers, however, and makes no provision for storing such markers hermetically to prevent their drying out when not in use. Further, such a device on provides for holding multiple marking implements, and itself must be held or placed nearby while the markers held therein are used.

U.S. Pat. No. 6,257,539 to Pelaez on Jul. 10, 2001 teaches a marker pen holder having two cavities in a housing designed for fixing to a person's belt, for example. Such a device, while providing a substantially air-tight seal around the marking end of a marker pen (herein referred to as "marker"), only provides for holding such markers in a convenient location. Further, such a device must be fastened to one's belt or other article of clothing, or else be held during use, occupying one of the user's hands. If the user of such a device needs to erase a mark on a whiteboard, for example, such a device becomes cumbersome to hold. Further, if the user is also using a laser pointing device or an eraser, such a marker pen holder must be placed nearby while the other implements are used.

Therefore, there is a need for a device that holds a plurality of marking pens hermetically, thereby allowing the pens to be stored in such a device without their individual caps. Such a needed device would not interfere with storing the caps of such markers on the ends of the markers, if provided for by the manufacturer of the marking pens. Further, such a needed device would incorporate other implements conveniently therein, such as a removable eraser pad and a laser pointer. Such a needed device would be easily grasped by a person with one hand while one of the markers is used with the user's other hand. The present invention accomplishes these objectives.

SUMMARY OF THE INVENTION

The present device is a caddy for holding at least one marker that has a marking end. The caddy comprises a body that has at least one elongated channel therein. Each channel is adapted to receive one of the markers slidably therein. Further, each channel terminates at a distal end in a fitted cap portion for hermetically receiving the marking end of one of the at least one markers, so that the marker stored therein does not dry out. Preferably the body is comprised of a plastic top shell and a plastic bottom shell each fixed together at a seam along peripheral edges thereof. The body further includes side edges, each having at least one ergonomic grip for facilitating the manual holding of the caddy.

The body further includes a substantially flat bottom side. At least one removable eraser pad may be fixed to the bottom side of the body. Preferably each eraser pad further includes a removal tab for facilitating the removal of the eraser pad when the eraser pad becomes soiled after substantial use.

In one mode of the invention, a battery-operated laser pointer device is further included within the body. A laser beam aperture and a laser actuator project through the body, the actuator manually operable to actuate the laser pointer device in order to produce a laser beam that projects through the laser beam apertures of the body. In such an embodiment, preferably the top and bottom shells are selectively separable so as to gain access to the laser pointer device for changing batteries therein, for example.

In use, a user may grasp the caddy with one hand while interchangeably selecting any of the markers for writing with the other hand on a whiteboard. The eraser pad may be used when the user desires to erase a mark on the whiteboard. Further, the laser pointer device may be actuated to point to objects or markings on the whiteboard. When the caddy is not in use, each marker fits within one of the fitted cap portions, which provides hermetic seal.

The present invention is a caddy that holds a plurality of marking pens conveniently and hermetically, thereby allowing the pens to be stored in such a device with their individual caps removed and perhaps stored on the ends of the markers, if desired and if provided for by the manufacturer of the marking pens. Further, the present device incorporates other implements conveniently therein, such as a removable eraser pad and a laser pointer. The present device is easily grasped by a person with one hand while one of the markers is used with the other hand. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
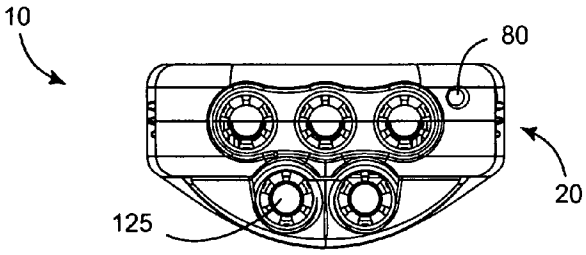
FIG. 1 is a front elevational view of a marker caddy.
Figure 2:
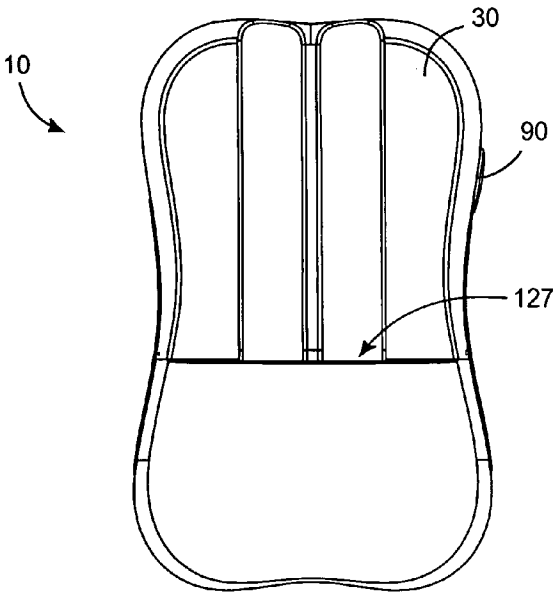
FIG. 2 is a top plan view of the invention.
Figure 3:
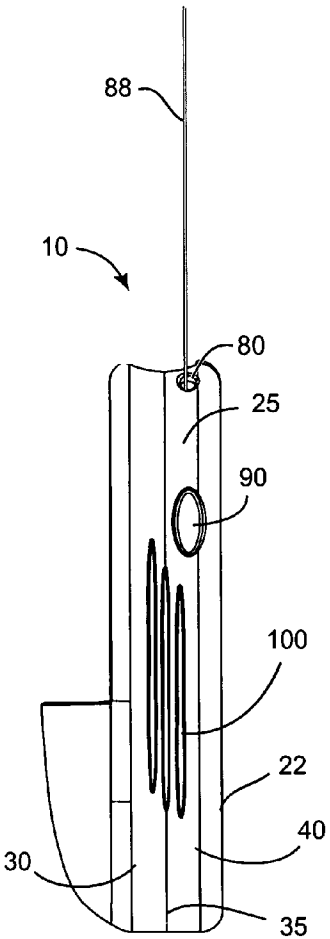
FIG. 3 is a right-side elevational view of the invention.

FIGS. 1-3 and 9 illustrate a caddy 10 for holding at least one marker 60 that has a marking end 65 and a cap end 68. Each marker 60 is preferably for use on a whiteboard (not shown), although other types of markers 60 can be used with the present invention.

Figure 4:
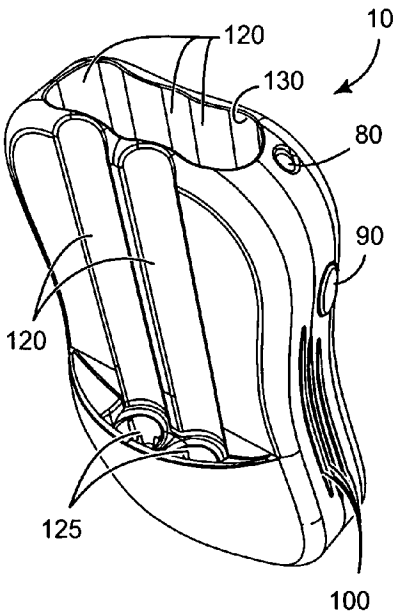
FIG. 4 is a perspective view of the invention.
Figure 5:
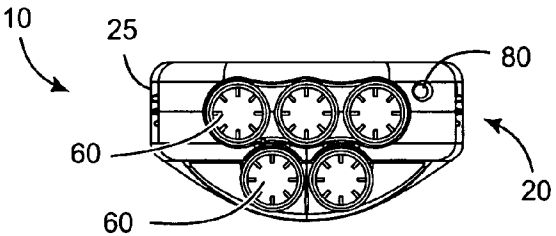
FIG. 5 is a front elevational view of the invention, illustrated with five markers stored therein.
Figure 7:
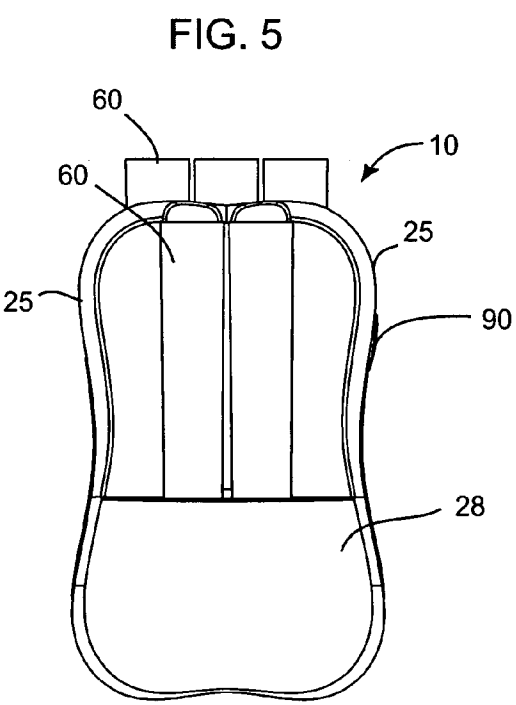
FIG. 7 is a top plan view of the invention, illustrated with the five markers stored therein.

The caddy 10 comprises a body 20 that has at least one elongated channel 120 therein. Each channel 120 is adapted to receive one of the markers 60 slidably therein. Further, each channel terminates at a distal end 127 (FIG. 2) in a fitted cap portion 125 for hermetically receiving the marking end 65 of one of the at least one markers 60. The body 20 preferably includes at least two of the channels 120 in a top side 28 thereof and three of the channels 120 may be formed into the body 20, each terminating at a marker aperture 130 in a front edge 24 of the body 20 (FIG. 4). The preferred embodiment results in a variety of five markers 60 being storable in the caddy 10 while still being easy to grasp and use. Clearly, however, various configurations of the channels 120 may be included in different embodiments of the caddy 10 as desired. The length of the channels 120 is less than the length of each marker 60 so that each marker 60 may be easily grasped.

The body 20 may be formed from a solid block of wood, plastic, or the like. Preferably, however, the body 20 is comprised of a plastic top shell 30 and a plastic bottom shell 40 each fixed together at a seam 35 along a peripheral edge 36,46 of each shell 30,40, respectively. The shells 30,40 may be bonded together with adhesive, mechanical fasteners (not shown), ultrasonically welded, or the like. The body 20 further includes side edges 25, each having at least one ergonomic grip means 100, such as elastomeric or vinyl strips or decals, for facilitating the manual holding of the caddy 10. Such ergonomic grip means 100 may be fixed to the body 20 with adhesive, or otherwise mechanically attached thereto as desired.

Figure 6:
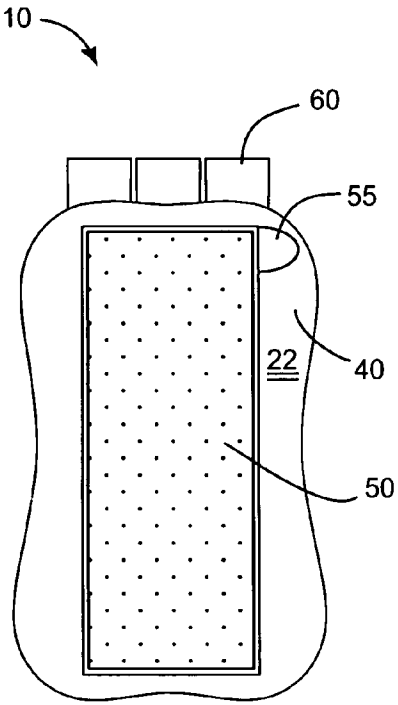
FIG. 6 is a bottom plan view of the invention, illustrating the markers stored therein and an eraser pad fixed to a bottom side of the invention.
Figure 8:
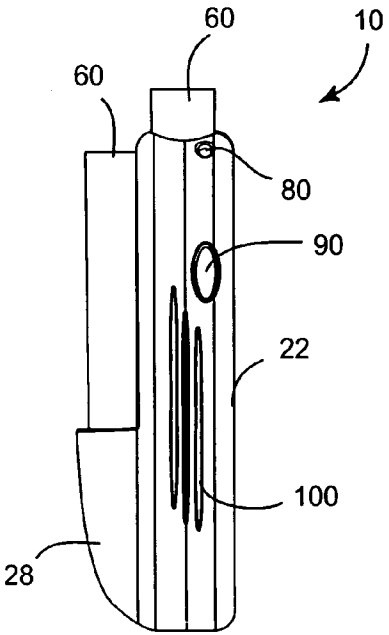
FIG. 8 is a right-side elevational view of the invention, illustrated with the markers stored therein.
Figure 9:
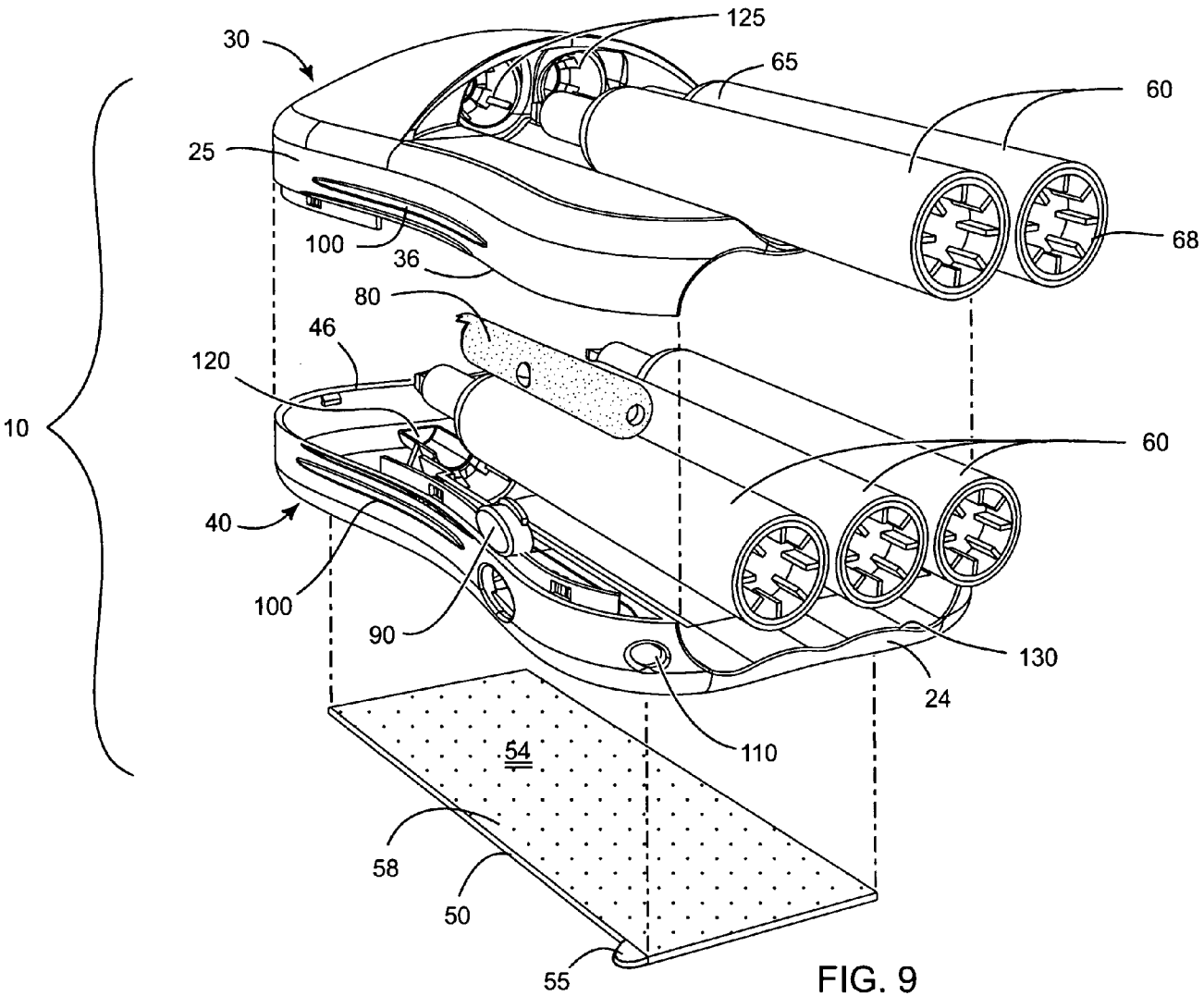
FIG. 9 is a perspective exploded view of the invention, illustrating a laser pointer fixed within a body of the invention.

The body 20 further includes a substantially flat bottom side 22. At least one preferably removable eraser pad 50 has on one side 54 thereof a body attachment means 58, such as adhesive, for fixing the one side 54 of the eraser pad 50 to the bottom side 22 of the body 20 (FIGS. 6 and 9). Preferably each eraser pad 50 further includes a removal tab 55 that does not include the attachment means 58, the removal tab 55 for facilitating the removal of the eraser pad 50 when the eraser pad 50 becomes soiled and needs replacement. The body attachment means 58 may also be a hook-and-loop type fastening material (not shown), or the like.

In one mode of the invention, a battery-operated laser pointer device 80 is further included within the body 20. A laser beam aperture 110 and a laser actuator 90 project through the body 20, the actuator 90 manually operable to actuate the laser pointer device 80 in order to produce a laser beam 88 that projects through the laser beam apertures 110 of the body 20 (FIGS. 3, 4, 5, 8 and 9). In such an embodiment, preferably the top and bottom shells 30,40 are selectively separable so as to gain access to the laser pointer device 80 for changing batteries therein (not shown), for example. As such, the shells 30,40 may be fixed together with a mechanical fastener such as screws (not shown), or the shells 30,40 may be formed to be selectively snapped together or separated.

In use, a user may grasp the caddy 10 with one hand (not shown) while interchangeably selecting any of the markers 60 for writing with the other hand on a whiteboard. The eraser pad 50 may be used when the user desires to erase a mark on the whiteboard. Further, the laser pointer device 80 may be actuated to point to objects or markings on the whiteboard. When the caddy 10 is not in use, each marker 60 fits within one of the fitted cap portions 125, which provides an air-tight seal so that the marker 60 does not dry out. If desired, the cap (not shown) of each marker 60 may be stored on the cap end 68 of the marker, as typically designed by the manufacturer of the marker 60. The caddy 60 does not interfere with such cap storage in use.

While a particular form of the invention has been illustrated and described, it will be apparent that various modifications can be made without departing from the spirit and scope of the invention. For example, various numbers and configurations of the channels 120 may be included in the invention. Accordingly, it is not intended that the invention be limited, except as by the appended claims.

What is claimed is:

1. A caddy for holding at least one marker having a marking end, the caddy comprising:

a compartmented body having at least one elongated channel therein each adapted to receive one of the at least one marker slidably therein and each channel terminating at a distal end thereof in a fitted cap portion for hermetically receiving the marking end of the one marker, the body further including a substantially flat bottom side, the body further including a laser pointer device therewithin, and a laser beam aperture and a laser actuator therethrough, the laser actuator manually operable to actuate the laser pointer device to produce a laser beam, the laser beam aperture coincident with the laser beam; and an eraser pad having on one side thereof a body attachment means for fixing the one side of the eraser pad to the bottom side of the body;

whereby a user may hold the caddy with one hand while interchangeably selecting from a received at least one marker; for writing with the other hand on a whiteboard, the eraser pad being used when the user desires to erase a mark on the whiteboard.

2. The caddy of claim 1 wherein the body has at least two of the elongated channels in a top side thereof, and three of the elongated channels therein and terminating at a marker aperture in a front edge of the caddy.

3. The caddy of claim 1 wherein the body further includes a pair of side edges, each having at least one ergonomic grip means to facilitate manual holding of the caddy.

4. The caddy of claim 1 wherein the body is comprised of a top shell and a bottom shell fixed together at a seam along a peripheral edge of each shell.

5. The caddy of claim 1 wherein the eraser pad includes a removal tab for facilitating the manual removal of the eraser pad.

* * * * *